US006006846A

United States Patent [19]

Tibbitts et al.

[11] Patent Number: 6,006,846

[45] Date of Patent: Dec. 28, 1999

[54] CUTTING ELEMENT, DRILL BIT, SYSTEM AND METHOD FOR DRILLING SOFT PLASTIC FORMATIONS

[75] Inventors: Gordon A. Tibbitts, Salt Lake City; Craig H. Cooley, South Ogden, both of Utah

[73] Assignee: Baker Hughes Incorporated, Houston, Tex.

[21] Appl. No.: 08/934,486

[22] Filed: Sep. 19, 1997

[51] Int. Cl.[6] ..... E21B 10/46

[52] U.S. Cl. ..... 175/428; 175/429; 175/434

[58] Field of Search ..... 175/431, 428, 175/432, 429, 420.2, 434

[56] References Cited

U.S. PATENT DOCUMENTS

| | | | |
|---|---|---|---|
| 4,158,521 | 6/1979 | Anderson et al. | 405/264 |
| 4,462,718 | 7/1984 | McLaughlin et al. | 405/264 |
| 4,794,994 | 1/1989 | Deane et al. . | |
| 4,848,489 | 7/1989 | Deane . | |
| 4,883,132 | 11/1989 | Tibbitts . | |
| 5,222,566 | 6/1993 | Taylor et al. . | |
| 5,314,033 | 5/1994 | Tibbitts . | |
| 5,377,773 | 1/1995 | Tibbitts . | |
| 5,447,208 | 9/1995 | Lund et al. | 175/428 |
| 5,492,188 | 2/1996 | Smith et al. | 175/432 |
| 5,558,171 | 9/1996 | McGlothlin et al. . | |
| 5,586,608 | 12/1996 | Clark et al. . | |
| 5,601,477 | 2/1997 | Bunting et al. . | |
| 5,653,300 | 8/1997 | Lund et al. . | |
| 5,706,906 | 1/1998 | Jurewicz et al. | 175/428 |
| 5,787,022 | 7/1998 | Tibbitts et al. | 364/578 |
| 5,813,485 | 9/1998 | Portwood | 175/430 |
| 5,839,526 | 11/1998 | Cisneros et al. | 175/431 |

OTHER PUBLICATIONS van Oort, Eric, Physico–Chemical Stabilization of Shales, SPE 37263, Society of Petroleum Engineers, Inc., 1996, pp. 1–16.

Aqua–Drill Plus advertisement, Oil & Gas Journal, Jun. 30, 1997, p. 20.

*Primary Examiner*—Frank Tsay

*Attorney, Agent, or Firm*—Trask, Britt & Rossa

[57] ABSTRACT

A cutting element and drill bits so equipped particularly suited for drilling subterranean formations exhibiting a superabrasive cutting face with at least a portion of extremely low surface roughness, by way of example on the order of a polished, mirror-like finish. The cutting face includes a peripheral cutting edge adjacent the low surface roughness portion of the cutting face for engaging a subterranean formation, the cutting edge being of sharp configuration and essentially defining a line of contact with the formation lying between the cutting face and a side surface of the cutting element extending rearwardly therefrom. In certain formations, particularly soft, plastic formations, the drill bits equipped with the inventive cutting element may be employed as a system and method with drilling fluids modified to maintain the integrity of formation cuttings by stabilizing and locking in reactive clays present in the rock to inhibit bit balling and facilitate hydraulic cuttings removal from the bit face.

38 Claims, 3 Drawing Sheets

CUTTING ELEMENT, DRILL BIT, SYSTEM AND METHOD FOR DRILLING SOFT PLASTIC FORMATIONS

BACKGROUND OF THE INVENTION

1. Field of the Invention

The present invention relates generally to drilling subterranean formations with rotary bits and, more specifically, to superabrasive cutting elements particularly suitable for drilling plastic formations, rotary bits so equipped, a drilling system employing such bits, and a method of drilling employing such bits.

2. State of the Art

Superabrasive cutting elements have been employed for many decades in the drilling of subterranean formations, especially for the production of hydrocarbons. Natural diamonds were first employed, but during the last twenty years, synthetic, polycrystalline diamonds, commonly referred to as polycrystalline diamond compacts, or PDCs, have become the superabrasive of choice for drilling most formations. A typical, state-of-the-art PDC cutting element exhibits a disk-like polycrystalline diamond "table" having a substantially flat, circular cutting face and formed in an ultra-high temperature, ultra-high pressure process onto a preformed, supporting substrate of cemented or sintered tungsten carbide (WC). Traditionally, a PDC cutting face has been lapped to a smooth finish. The PDC cutting elements as described are fixed to so-called rotary "drag" bits used to shear material from a rock formation being drilled by contact of the cutting elements with the formation under rotation and applied weight on bit (WOB).

While PDC cutting element-equipped bits have proven very effective in cutting certain formations, other formations, particularly some of those which fail plastically, have presented a substantial obstacle to effective and efficient PDC drag bit drilling due to the tendency of cuttings from those formations to adhere to the cutting faces of the cutting elements. For example, PDC cutting elements shear some shales with little problem, generating formation cuttings or "chips", which can be removed from the bit face using conventional bit hydraulics. As pressure stresses increase with well bore depth, however, a formation becomes more plastic and requires different bit cutting mechanics to cut efficiently. Such difficult formations include, by way of example, highly pressured or deep shales, mudstones, siltstones, and some limestones. The problem is exacerbated as the density of the well bore fluid increases.

Shale and other ductile formations tend to flow more easily at stress and thus conform, and adhere more strongly, to surfaces they contact. As a result, shear stress necessary to displace a cutting from the cutting face of a cutting element increases significantly. In fact, it is believed that the shear stress required to displace a formation cutting from a cutting face may be higher than the stresses initially required to shear the cutting from the formation. Formation cuttings adherence to the cutting face thus may result in a relatively stationary mass of formation material built up immediately ahead of the cutting edge at a periphery of the cutting face. This mass comprises a tough, solidified agglomeration of formation cuttings, initiated through shear enhanced compaction and hydration of the formation material. As a result, instead of contact between the cutting face and the uncut formation comprising a point or line (depending on the degree of wear of the cutting element) at the peripheral cutting edge of the cutting face, the cuttings mass, sometimes referred to as a built up edge (BUE), presents a very dull or blunt geometry to the formation, resulting in a much larger area of contact with the uncut formation material, compressing the formation material and increasing the effective stress of the formation being cut. Further, the presence of this mass moves the cutting action away from and ahead of the cutting edge, altering the failure mechanism and location of the cutting phenomenon so that cutting of the formation is actually effected by the mass itself, which obviously is quite dull, rather than by the cutting edge as intended. Thus, the presence of a BUE hinders the performance of the cutting element and lowers the rate of penetration (ROP) of the bit on which it is employed.

In recent years, a substantial and commercially successful solution to the chip-to-cutting face adherence problem has been developed. U.S. Pat. Nos. 5,447,208 and 5,653,300, assigned to the assignee of the present invention and incorporated herein for all purposes by this reference, disclose and claim the use of superabrasive (also sometimes termed "superhard") cutting elements exhibiting cutting faces or cutting face portions which are polished or otherwise worked or formed to an extremely high degree of smoothness, including to a mirror-like finish. Such cutting elements have demonstrated a superlative ability to resist adherence of the aforementioned plastic formation cuttings to the cutting face, thus avoiding the BUE comprising a mass of formation material located ahead of the cutting edge, and promoting cutting adjacent the cutting edge itself.

While the mechanism by which cuttings adherence is not fully understood, it is believed to be largely attributable to a substantial (on the order of 50% or more in comparison to conventional, lapped cutting elements) reduction in the coefficient of friction of the cutting face portion which exhibits the aforementioned extremely smooth finish. This significant reduction in friction between the cutting face and formation, and consequent reduction in cuttings adhesion, reduces the shear stress of or resistance to movement of formation cuttings across the cutting face, and thus the normal as well as tangential forces required for a specified depth of cut in a given formation. In addition, the compressive rock strengthening effect that often occurs in front of a cutting element due to the presence of the BUE is avoided. The reduction in friction has even, surprisingly, been demonstrated to overcome the phenomenon of cuttings adherence to the cutting face of a cutting element due to the presence of a positive pressure differential on a formation cutting arising out of the presence of greater well bore pressure on the outside, or exposed face, of the cutting, than ambient formation pressure present on the side of the formation cutting lying adjacent the cutting face across which it is traveling. In extensive field use, the polished cutting face PDC cutting elements have also demonstrated a marked superiority in rate of penetration (ROP) even in non-plastic formations, as well as in durability and resistance to wear during the drilling process.

However, field experience with polished cutting elements has also demonstrated a new difficulty in the drilling of some plastic formations, even with the above-described cutting action occurring proximate the actual cutting edge of the cutting element, rather than ahead of the cutting edge. This edge-cutting action results in long, ribbon-like cuttings akin to a cutting taken by running a knife across a cake of soap. In certain formations, particularly those such as shales including a significant volume of reactive clays, cuttings from the various cutting elements on the cutting face of a typical, multi-cutting element PDC bit may quickly agglomerate into a semi-solid mass which must literally be extruded through the junk slots on the gage of the bit, thus defeating the bit hydraulics and preventing their effective removal up the well bore annulus to the surface. This junk slot clogging with an agglomeration of cuttings in turn foments a build-up of subsequent cuttings above (as the bit is oriented during drilling) the agglomeration on the bit face, until the bit generates a mass of agglomerated cuttings covering the bit face. At this point the bit "balls up" and ceases drilling when the cutting elements are no longer cutting the formation, but riding on the agglomerated cuttings mass.

Chip breakers have been used to fragment the long, ribbon-like cuttings into shorter segments. Additionally, hydraulic design and drilling fluid flow volume of state-of-the-art bits have been enhanced in order to move the cuttings more efficiently to and through the junk slots. However, in many instances polished PDC cutting element drag bits can still literally out-drill their ability to dispose of formation cuttings. As a result, rotary speed and weight on bit may be undesirably limited in order to reduce the volume of formation cuttings to a level commensurate with the bit's ability to move the cuttings away from the bit face and up the annulus. Consequently, ROP is lessened, and rig time increased, to drill an interval through formations through which polished PDC cutting element drag bits are otherwise ideally suited. Stated another way, in such situations, ROP becomes a function of the rate of extrusion of the agglomerated cuttings mass through the junk slots of the bit.

The required use of water-based, rather than oil-based, or water-in-oil invert emulsion drilling fluids in environmentally-sensitive or otherwise highly regulated drilling locations may also severely limit the ROP of PDC-equipped drag bits, particularly in deeper shales. Many, if not most, water-based drilling fluids fail to prevent or even substantially retard the above-referenced cuttings agglomeration problem, which is attributable to the presence of reactive clays in such formations. Reactive clays may generally be categorized as those which change atomic structure or physical properties in the presence of a water-based drilling fluid system, leading to the above-referenced cuttings agglomeration problem.

Further, conventional wisdom regarding PDC cutting element design has dictated that the cutting edge of such a cutting element (including so-called polished cutting elements) be beveled or chamfered to a noticeable degree, typically to at least 0.010 inch looking face-on and perpendicular to the cutting face and most commonly at a 45° angle to the longitudinal cutter axis. This chamfering or beveling has been shown to be effective in tougher or harder formations, or lenses, in order to reduce chipping and potential fracture of the superabrasive table until the cutting element begins to form a wear flat along the line of contact with the formation, extending the line to a surface of contact transverse to the direction of travel of the cutting element as it moves with rotation and downward movement of the drag bit to which it is secured. Unfortunately, chamfers or bevels of a magnitude sufficient to reduce damage to the superabrasive tables also result in a relatively blunt cutting element presentation to the formation. This type of cutting edge geometry actually increases the stress required to fail the formation rock opposite the chamfer, particularly in rocks which fail plastically. Therefore, PDC cutting element cutting efficiency is not optimized, even with an extremely smooth, polished cutting face according to the '208 patent.

Thus, the state of the art has failed to date to provide a means and method for taking full advantage of polished cutting face cutting elements in formations for which they are particularly suited.

BRIEF SUMMARY OF THE INVENTION

The present invention includes a cutting element configuration particularly suitable for drilling formations which fail in a plastic manner, sometimes referred to in the art as "soft" formations, including those having harder rock "stringers" running therethrough, as well as rotary drag bits so equipped, in combination with a drilling fluid formulated as required to substantially reduce a given plastic formation's tendency to agglomerate into a solid mass, rather than remain as discrete cuttings. When such a drilling fluid is employed, the invention may also be characterized as encompassing a method of drilling, as well as a drilling system.

In its simplest form, the present invention comprises a cutting element exhibiting a superabrasive cutting face extending in two dimensions transversely to the direction of intended cutting element travel during drilling, at least a portion of the cutting face being provided with a smooth, low-friction surface and having a cutting edge at an outer periphery of the smooth cutting face portion which comprises a sharp, rather than chamfered or beveled, edge. The low friction surface may comprise a polished, substantial mirror finish of superabrasive material, or may comprise a coating. As used herein, the term "sharp edge" encompasses a boundary between the cutting face and an adjacent side of the superabrasive table which exhibits no chamfer or bevel visible to the naked eye, but which may be worked by burnishing, honing or other known techniques to a fine, rounded edge of no more than a few thousandths of an inch radius or a flat or multi-flat (chamfer or multi-chamfer) edge of no more than a few thousandths of an inch radial width at the cutting face periphery. Such a sharp-edged, polished, superabrasive cutting element may be employed in the aforementioned plastic formations without substantial risk of damage, and demonstrates a cutting efficiency far superior to conventionally chamfered, polished cutting elements, permitting increased rate of penetration for a given weight on bit and drill string rotational speed.

In formations exhibiting hard stringers, the increased cutting efficiency permits reduced rotational speed and WOB while still maintaining an acceptable ROP. To address formations with a particularly high volume of stringers, or to drill an extended interval through a stringer-laden formation, it is also contemplated that the invention may be embodied by a drill bit carrying both conventional, i.e., chamfered, preferably polished cutting elements in combination with sharp, polished cutting elements. The sharp and conventionally-edged cutting elements are placed so that each type provides coverage on all radii on the bit face, the conventionally-edged cutting elements providing protection for the sharp-edged elements when stringers are encountered. During drilling, the sharp-edged cutting elements will effect a relatively deep depth of cut (DOC) in soft formations, while stringers or harder formation material encountered during drilling will reduce DOC, affording protection for the sharp cutting edges by taking more of the formation contact on the chamfered cutting edges.

In plastic formations including a volume of reactive clays sufficient to result in the aforementioned cuttings agglomeration problem, the inventors have discovered that water-based drilling fluid characteristics may be beneficially modified to accommodate the enhanced cutting efficiency of the sharp-edged, polished cutting elements. Specifically, these drilling fluids as employed with such cutting elements may be additive-enhanced so that the micro-fractures or micro-tears in the cuttings normally exposing a large surface area of the reactive clay material and thus fomenting cuttings agglomeration are instead exposed to a drilling fluid environment which "locks" or stabilizes the otherwise reactive clays. As a result, the cuttings maintain their ribbon-like shape and can be effectively fragmented into shorter segments (which likewise substantially maintain their integrity) with hydraulic flow from nozzles on the bit face, or by contact with chip-breaking structures on the cutting element or otherwise carried by the bit. The chip segments may then be flushed through the junk slots of the bit, greatly reducing the tendency of the bit to ball. Thus, use of such drilling fluid modifications to prevent instantaneous bit balling due to cuttings agglomeration permits a much higher volume of cuttings to be removed through the junk slots, permitting the operator to take full advantage of the enhanced cutting efficiencies exhibited by the sharp-edged, polished cutting elements.

Further, it may be desirable to employ DOC limiters as known in the art to control penetration rate of a bit equipped with sharp-edged cutting elements according to the present invention, maintaining ROP within a sustainable range which will not result in generation of a formation cuttings volume in excess of the bit's ability to clear same through the junk slots.

DETAILED DESCRIPTION OF THE INVENTION

Figure 1:
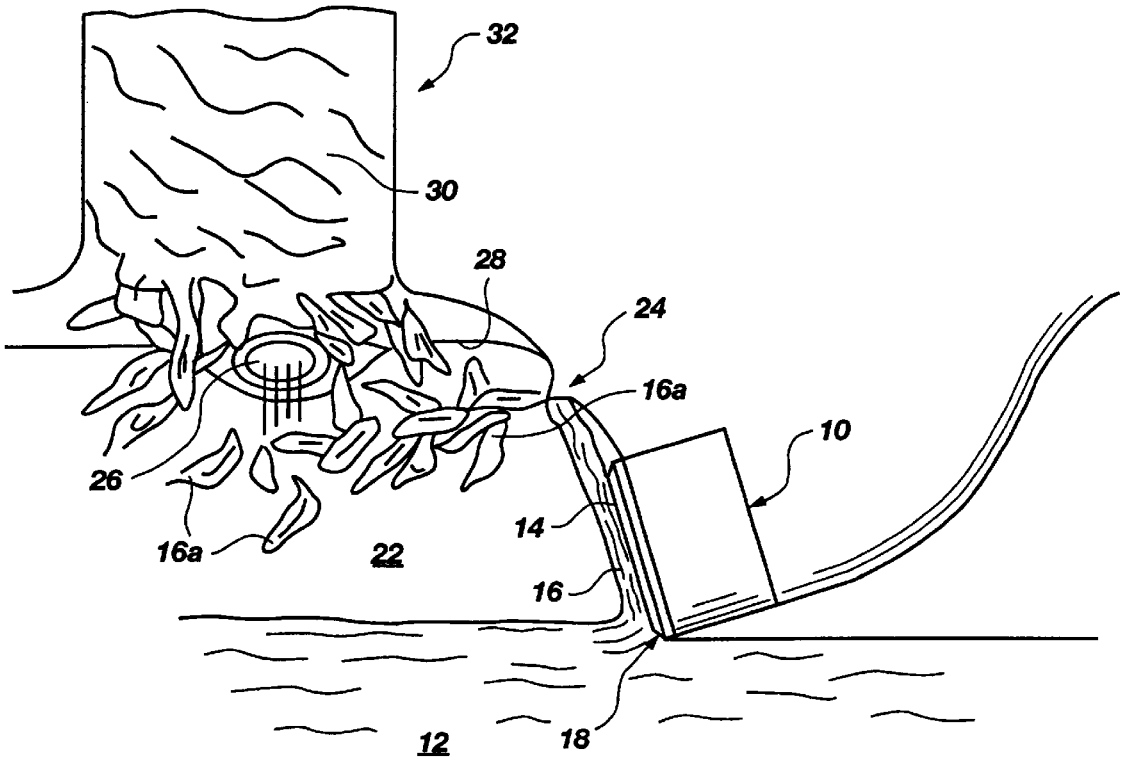
FIG. 1 is a side elevation of a prior art chamfered cutting edge cutting element exhibiting a polished cutting face, in the process of cutting a plastic formation of a rock having a tendency toward cuttings agglomeration in the presence of a conventional water-based drilling fluid.

Referring now to FIG. 1 of the drawings, a prior art, chamfered PDC cutting element 10 comprising a tungsten carbide substrate bearing a superabrasive mass or table having a polished cutting face 14 is depicted as cutting material from the surface of plastic formation 12. It can readily be seen that the presence of the polished cutting face precludes the development of a built-up edge of formation material ahead of the cutting face 14 in accordance with the teachings of the '208 and '300 patents. Rather, an elongated, ribbon-like formation cutting 16 is generated and rides freely across the polished cutting face 14.

Figure 1A:
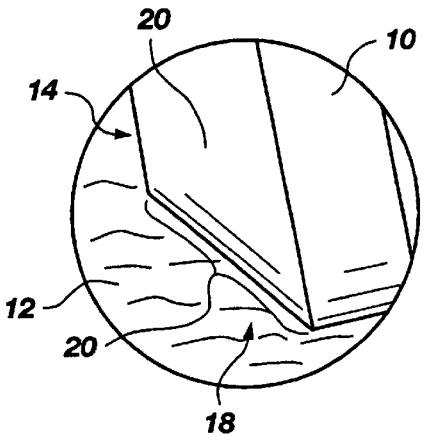
FIG. 1A is an enlarged view of the area of contact between the chamfered cutting edge of the cutting element of FIG. 1 and the plastic formation.
Figure 1B:
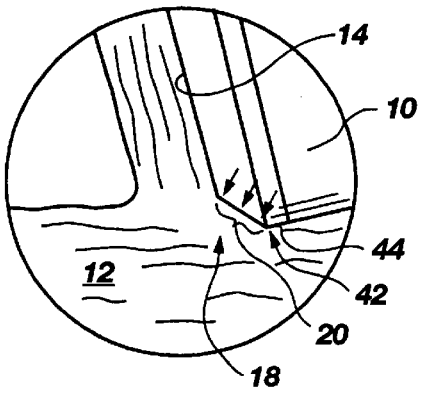
FIG. 1B is an enlarged view of the area of contact between the chamfered cutting edge of the FIG. 1 cutting element and the plastic formation, showing the manner in which stress applied by the chamfered surface is diffused and a thick formation cutting is formed.

However, it can also be seen that the cutting "edge" 18 of cutting element 10 can, in reality, comprises a chamfer exhibiting an arcuate, semi-annular surface 20 (see FIG. 1A) which bears against the formation, creating a substantial compressive stress thereon and actually increasing the strength, or resistance, of the formation being cut. As noted above, a typical conventional chamfer size would comprise a minimum of about 0.010 inch radial width and be oriented at a 45° angle, although far larger chamfers and angles other than 45° are also known in the art. For a square or tombstone-shaped cutting face, the surface 20 would comprise an angled flat or chamfer extending substantially linearly, but nonetheless would still comprise a substantial contact area. Moreover, contact of chamfer area 20 results in a region of relatively diffused stress when compared to the desired, localized stress concentration afforded by the sharp-edged cutting elements of the invention as hereinafter described. As can be seen in FIG. 1B, although shearing of formation material occurs at edge 42 proximate sidewall 44 of the superabrasive mass or table, the stress applied to the formation by cutting element 10 is distributed or diffused over the rock area opposing chamfer surface area 20. Thus, to effect a desired depth of cut, the WOB may have to be increased to an unacceptable level, and to effect a desired ROP, the torque on the drill string may also have to be unacceptably increased to achieve the required rotational speed. In cases where downhole motors such as Moineau motors or turbines are used, as is common in directional or steerable bottomhole assemblies, increased WOB may cause the motor to stall, and the required torque may not be achievable due to output limitations associated with such motors.

Moreover, FIG. 1 also depicts the tendency of ribbon-like formation cuttings 16 in the presence of a conventional water-based drilling fluid 22, even after fragmentation into smaller segments 16*a* by contact with a chip breaker 24 and a directed stream of drilling fluid from a nozzle 26 on the bit face 28 to agglomerate into a semi-solid mass 30 which compromises bit hydraulics and clogs junk slot 32, leading to bit balling.

Figure 2:
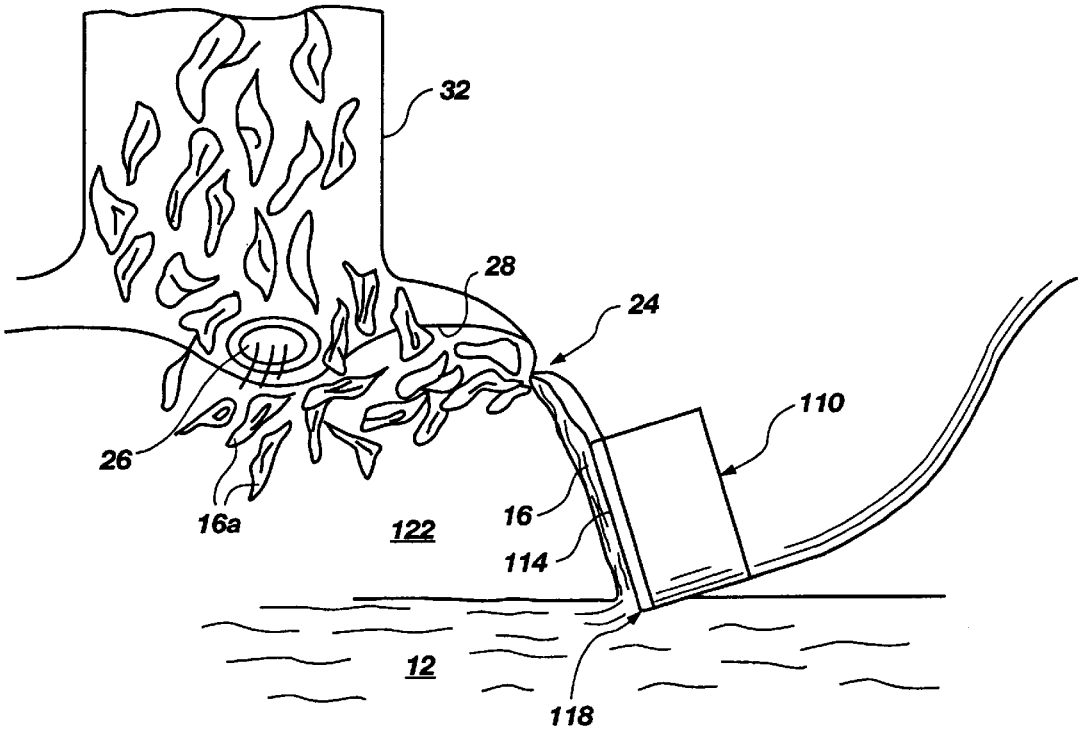
FIG. 2 is a side elevation of a sharp cutting edge cutting element exhibiting a polished cutting face, in the process of cutting the same plastic formation as in FIG. 1 in the presence of a water-based drilling fluid modified in accordance with the invention.
Figure 2A:
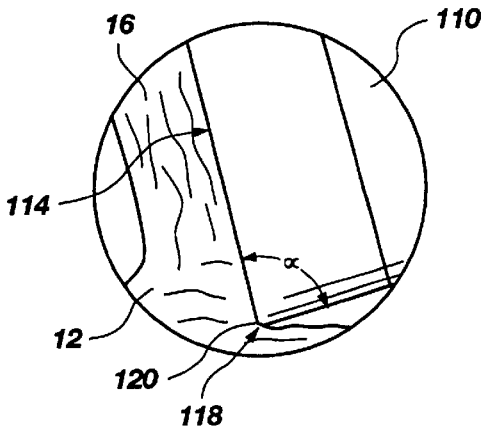
FIG. 2A is an enlarged view of the area of contact between the sharp cutting edge of the cutting element of FIG. 2 and the plastic formation.
Figure 2B:
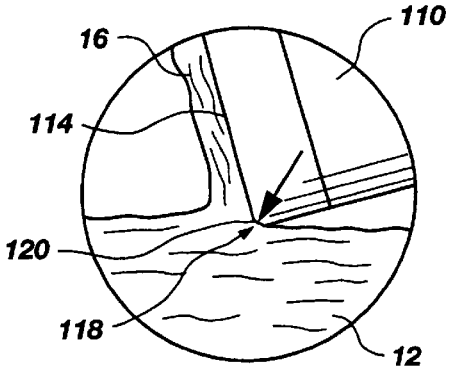
FIG. 2B is an enlarged view of the area of contact between the sharp cutting edge of the FIG. 2 cutting element, showing the manner in which stress applied by the sharp edge is localized and a thin formation cutting is formed.

Referring to FIG. 2 of the drawings, a PDC cutting element 110 according to the present invention (again comprising a superabrasive mass supported by a tungsten carbide substrate) is depicted as cutting a thin ribbon 16 of material from the surface of the same plastic formation 12. The cutting face 114 of cutting element 110 is polished in the same manner as that of cutting element 10, in accordance with the teachings of the '208 patent. However, the cutting edge 118 of cutting element 110 (see FIG. 2A) comprises a true, sharp "edge" or line of contact 120 exhibiting no two-dimensional surface easily discernable to the naked eye. As noted previously, the cutting edge 118 may be rounded by burnishing or otherwise worked to an extremely small radius (illustrated in exaggeratedly large size in FIG. 2A) of no more than about 0.005 inch, and preferably about 0.002 to 0.003 inch, to eliminate or reduce potential nucleation or flaw sites along the edge itself Alternatively, cutting edge 118 may exhibit an extremely small, flat chamfer or bevel (illustrated in exaggeratedly large size in FIG. 2B), on the order of no more than 0.005 inch width, and preferably about 0.002 to 0.003 inch width, looking face-on and perpendicular to the cutting face 114. Multiple flats or chamfers may also be employed at the cutting edge and within the referenced dimension range. However, for practical purposes, as shown in FIG. 2B, the line-of-contact sharp cutting edge drastically increases the unit stress on the formation at the contact point, in some instances by an order of magnitude, focusing or localizing the stress on the formation to induce failure thereof in a small, finite area. As a result, required WOB and applied torque to maintain a given DOC and rotational speed are measurably decreased.

Also shown in FIG. 2 is the maintenance of the integrity of the formation cuttings ribbons 16 in the presence of enhanced clay-stabilizing drilling fluid 122, even after the ribbons 16 are fragmented into smaller segments 16*a* by contact with chip breaker 24 and a directed drilling fluid stream from nozzle 26 on bit face 28. Hence, junk slot 32 remains free to convey cutting segments 16*a* carried by drilling fluid 122.

As used herein, the term "superabrasive" includes, by way of example only, polycrystalline diamond compacts, thermally stable polycrystalline diamond compacts, cubic boron nitride compacts, diamond films, and cutting elements including one or more of the foregoing materials. It is currently contemplated that the best mode of practicing the invention employs polycrystalline diamond compacts.

Further, as used herein the term "polished" as describing or characterizing the surface roughness of a cutting face or other surface of a superabrasive table of a cutting element encompasses surfaces having an RMS surface roughness of about 10 $\mu$in. or less, preferably about 5 $\mu$in. or less, and most preferably about 2 $\mu$in. or less, as disclosed in the aforementioned '208 and '300 patents. Further, and again as described in the '208 and '300 patents, only a portion of a cutting face adjacent the cutting edge need be polished or otherwise formed to the requisite smoothness to employ the advantages of the invention. It is also desirable, although not required, that the side of the cutting element to the rear of the cutting edge also be polished for enhanced durability, for reduction of sliding friction against the formation, and to assist in maintaining the sharp cutting edge of the cutting element for an extended duration.

In addition to the use of the aforementioned polished cutting faces on cutting elements according to the invention, it is also contemplated that cutting faces may be coated or impregnated with materials to provide low-friction surfaces. While no specific materials are preferred at this time, ceramic, metallic and polymer coatings are contemplated as having utility, as are synthetic fluorine-containing resins comprising Teflon® type materials, with which the superabrasive may be impregnated.

In further describing the characteristics of a cutting edge according to the invention, the term "sharp" is used herein to identify a cutting edge comprising essentially a line of contact defined between a peripheral portion of the cutting face and an adjacent side of the cutting element oriented toward the formation. The term "line of contact" is intended to distinguish prior art cutting elements bearing a cutting face separated from a side of the cutting element by at least one intervening chamfer or bevel of a different angular orientation with respect to the formation being cut between that of the cutting face and side, and of sufficient width to present a bearing surface against the formation.

Characterized in terms of a preferred relative included angle between the cutting face and adjacent side oriented toward the formation, it is contemplated that a sharp cutting edge according to the invention may exhibit an included angle a (see FIG. 2A) along the line of contact defined between the cutting face periphery and adjacent side oriented toward the formation within the range of less than about 90° to no more than about 115°.

Characterized in terms of a preferred effective cutting face fore-and-aft rake (commonly termed "backrake"), it is contemplated that the cutting face adjacent the cutting edge may have a neutral or 0° rake, a positive rake (leaning with its cutting edge forward and toward the formation) or a slight negative rake (leaning backward) of no more than about 30°. Again referring to FIGS. 2, 2A and 2B, it will be appreciated that the inventive cutting elements 10 may be preferably only minimally negatively backraked so as to effect a more vertical or upright shear plane with respect to the formation. Such an orientation results in a relatively thinner, softer formation cutting or chip sheared from the formation than if a more negatively backraked cutting face aspect is employed. Relatively greater negative backrake of the cutting face, even when no perceptible chamfer is employed, promotes a thicker, stickier, harder and more glob-like chip due to increased compression and deformation of the formation material by the cutting face of the cutting element. Stated another way, use of a small backrake permits the cutting element to cleanly shear a relatively well-defined layer of formation material from the as-yet-uncut formation face at the bottom of the well bore, while use of a larger backrake, particularly in combination with a substantial chamfer, applies loading by the cutting element more transversely to the formation face, compressing the formation material and increasing its resistance to shearing by the cutting element.

The cutting face of a sharp cutting edged cutting element according to the invention may be flat, concave, convex, or of diverse topography, but which nonetheless presents a two-dimensional cutting face which is intended to be oriented substantially transversely to the direction of movement when the cutting element is mounted to a drill bit. The superabrasive table may be of any thickness as known in the art which is sufficiently robust to endure the drilling process, and the invention specifically contemplates the use of extremely thick superabrasive tables in excess of conventional 0.030 inch thick superabrasive tables, up to and including superabrasive tables exhibiting a thickness in whole or in part in excess of 0.300 inch. Likewise, the specific structure of a superabrasive cutting element is of no effect on the utility of the invention, and it is contemplated that free-standing superabrasive masses as well as traditional carbide substrate-backed superabrasive masses may be employed with the invention. If backed with a substrate, the superabrasive table-to-substrate interface may be planar, non-planar, regular or irregular, symmetric with respect to the transverse cross-section of the cutting element, or non-symmetrical. The cross section of a cutting element cutting face according to the invention may be circular, on comprise part of a circle, rectangular, "tombstone" shape or otherwise as known or contemplated in the art.

Figure 3:
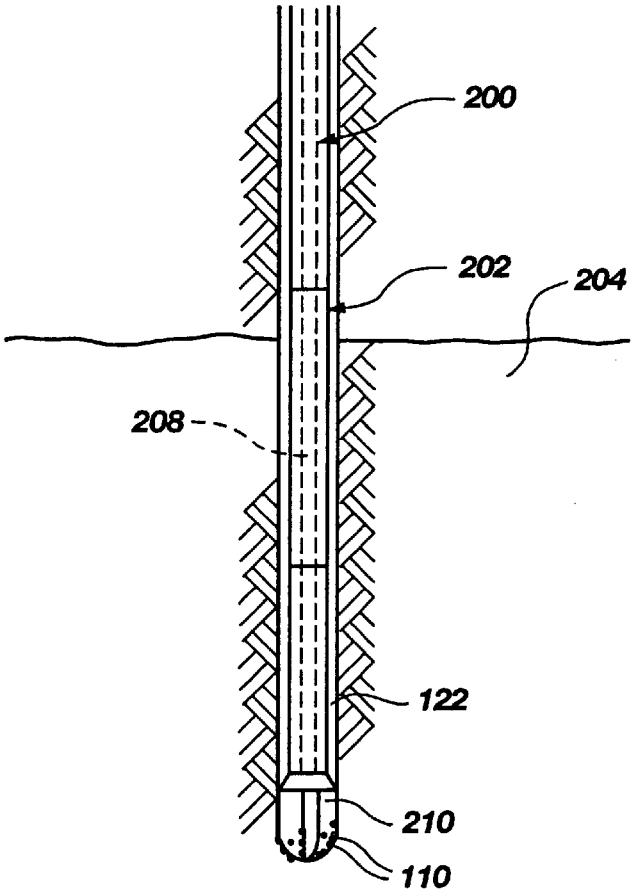
FIG. 3 is a schematic side elevation of a drill string disposed in a well bore with a drill bit including sharp cutting edge cutting elements according to the present invention drilling through a plastic formation in the presence of a clay-stabilizing additive enhanced drilling fluid.

FIG. 3 depicts a drill string 200 disposed in a well bore 202 and in the process of drilling through a soft, plastic formation interval 204. Rotary drag bit 210 having cutting elements 110 according to the invention mounted thereto is penetrating formation interval 204 responsive to application of suitable torque and WOB. A volume comprising a metered flow or stream, or a slug or "pill", of enhanced reactive clay-stabilizing drilling fluid 122 may be introduced into the well bore 202 down the interior 208 of drill string 200 and out the face of bit 210 immediately prior to bit 210 entering interval 204. Pumping of fluid 122 in a controlled or metered fashion is then continued as interval 204 is traversed by bit 210. The quantity of such drilling fluid 122 introduced during penetration of interval 204 is naturally dependent upon the depth or thickness of the interval, ROP, well bore diameter and drilling fluid flow rate. It suffices to say that drilling fluid 122 should be circulated until such time as interval 204 has been completely traversed, and those of ordinary skill in the drilling art are capable of computing the required volume of drilling fluid 122.

The tendency of shales toward instability, based in large part on the swelling of clays present therein, is discussed in SPE Paper No. 37263, "Physico-Chemical Stabilization of Shales", by Van Oort, February 1997. Also presented in the paper are various approaches to stabilize shales employing various water-based drilling fluids. It is contemplated that such fluids may be employed in the present invention to maintain the integrity of the formation cuttings in the practice of the present invention.

A specific suitable drilling fluid composition to employ as required when drilling active shale formations including a sufficient volume of reactive clays include various water-based drilling fluid compositions enhanced with a Terpene Alternative Chemistry (TAC) additive marketed as PENETREX™ by Baker Hughes Incorporated of Houston, Tex., through the Baker Hughes INTEQ operating unit. Specifically, lignosulfonate fluids, bentonite/PAC fluids, PHPA fluids including glycol/NaCl/PHPA and NaCl/PHPA, polyglycol based fluids, and CaCl/polyglycol fluids, each as enhanced with the TAC additive, are believed to be suitable for shale stabilization. It has been shown to date that as little as 1.5% by volume of the TAC additive is effective to reduce a tendency toward bit balling in active shales and increase ROP. However, it is currently believed that including from 3% to about 10% by volume of the additive in the drilling fluid system, and in many instances about 3% to 5% by volume, will suppress balling and optimally increase ROP when used in combination with polished, sharp-edged cutting elements according to the invention. The additive engages free water in the shale cuttings, stabilizing the material before agglomeration may occur.

Another suitable drilling fluid for preventing bit balling is disclosed in U.S. Pat. No. 5,586,608, assigned to the assignee of the present invention. The disclosed fluid is an oil-in-water emulsion utilizing a polyol having a cloud point such that uphole the polyol is soluble in the water phase and downhole the polyol is soluble in the oil phase of the emulsion.

Yet another drilling fluid which may be suitable for clay stabilization is disclosed in U.S. Pat. No. 5,558,171 as alkaline water-based fluids having a clay stabilizing additive comprising a polyfunctional polyamine reaction product prepared by the reaction of a polyamine based reactant with urea to an intermediate reaction product, which in turn is reacted with a dialkylcarbonate. The pH of the stabilization additive is then reduced, and the additive incorporated in the alkaline drilling fluid.

In addition, the aforementioned oil-based and invert emulsion drilling fluids may also be employed to practice the invention in clay-bearing formations when conditions permit.

To summarize, the practice of the present invention as a system or method for drilling in formations requiring stabilization of formation cuttings may be practiced with any drilling fluid suitable to effect such stabilization, in combination with the sharp, polished cutting face cutting elements of the invention. While less effective, it is also contemplated that the invention may be practiced with sharp-edged but conventionally finished (i.e., lapped) cutting elements employed with a suitable drilling fluid system effecting the desired cuttings stabilization.

Figure 4:
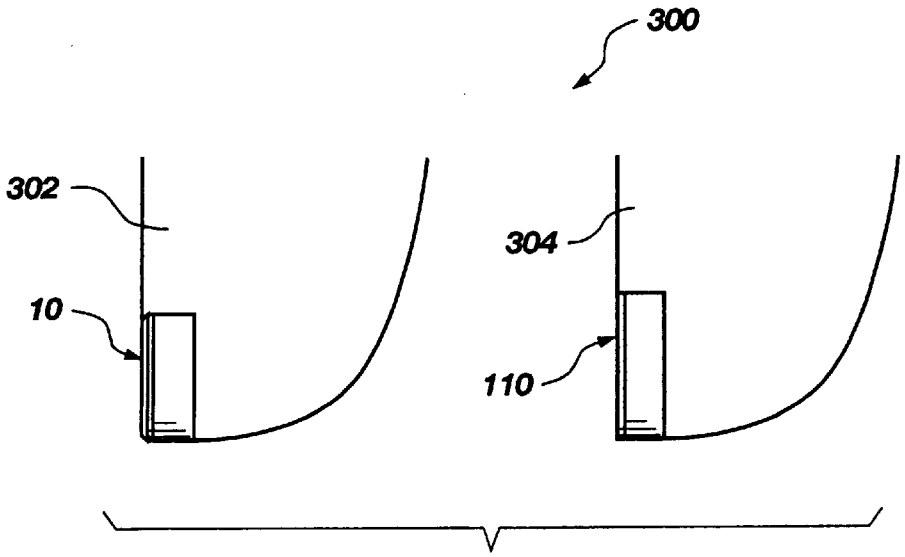
FIG. 4 is a view of two blades of a rotary drag bit according to the invention designed for cutting stringer-laden plastic formations, the blades being rotated for clarity out of their normal radial orientations into a mutually parallel relationship perpendicular to the page, the leading blade bearing conventional chamfered cutting elements having polished cutting faces while the trailing blade carries the polished, sharp cutting edge cutting elements.

FIG. 4 illustrates a drill bit 300, blades 302 and 304 of which have been rotated out of their normal radial alignments to positions perpendicular to the drawing sheet for clarity. Leading blade 302 carries a plurality of prior art, chamfered, polished cutting elements 10 (only one shown for clarity), while trailing blade 304 carries a plurality of polished, sharp-edged cutting elements 110 according to the present invention. Cutting elements 10 and 110 are arranged to sweep the formation at overlapping radial locations. Drill bit 300 is especially suitable for drilling soft, plastic formations bearing hard stringers therein, which stringers may damage the sharp cutting edges of the cutting elements 110. The chamfered cutting elements 10 take the brunt of impact with stringers, which limit DOC, while the sharp-edged cutting elements 110 efficiently cut soft, plastic formation material to a greater DOC when no stringers are present. DOC may be controlled by the density of cutting elements employed on the bit face, the number of sharp versus chamfered cutting edge cutting elements, and weight on bit. As noted in U.S. Pat. Nos. 5,314,033 and 5,377,773, assigned to the assignee of the present invention, positively backraked cutting elements may be combined with negatively backraked cutting elements, if it is desired to employ sharp, positively-raked cutting elements in proximity to chamfered negatively-raked cutting elements for protection in stringers and as DOC limiters. Alternatively, cutting elements including both positively- and negatively-raked cutting faces according to these patents may be similarly employed.

While the invention has been described in terms of certain disclosed embodiments as illustrated herein, those of ordinary skill in the art will understand and appreciate that it is not so limited. Additions, deletions and modifications may be made to the embodiments of the invention as disclosed without departing from the scope of the invention as hereinafter claimed.

What is claimed is:

1. A cutting element for drilling subterranean formations, comprising:

a cutting face comprising a superabrasive mass extending in two dimensions, said cutting face including at least a portion exhibiting a surface of sufficient smoothness to substantially overcome a tendency of formation cuttings to adhere thereto; and a sharp cutting edge at an outer periphery of said cutting face portion, said cutting edge defined by at least one radius of no more than about 0.005 inch or at least one chamfer having a radial width of no more than about 0.005 inch, said cutting edge lying between said cutting face portion and a side of said superabrasive mass.

2. The cutting element of claim 1, wherein said cutting edge is worked.

3. The cutting element of claim 1, wherein said at least one radius is no more than about 0.003 inch.

4. The cutting element of claim 1, wherein said radial width of said at least one chamfer comprises no more than about 0.003 inch.

5. The cutting element of claim 1, wherein said cutting face portion exhibits a mirror-like surface finish.

6. The cutting element of claim 1, wherein an included angle between said cutting face and said side is no more than about 115°.

7. The cutting element of claim 1, wherein an included angle between said cutting face and said side is no more than about 115°.

8. A cutting element for drilling subterranean formations, comprising:

a cutting face comprising a superabrasive mass extending in two dimensions, said cutting face including at least a portion exhibiting a surface with a sufficiently low coefficient of friction to substantially overcome a tendency of formation cuttings to adhere thereto; and a sharp cutting edge at an outer periphery of said cutting face portion, said cutting edge defined by at least one radius of no more than about 0.005 inch or at least one chamfer having a radial width of no more than about 0.005 inch, said cutting edge lying between said cutting face portion and a side of said superabrasive mass.

9. The cutting element of claim 8, wherein said cutting edge is worked.

10. The cutting element of claim 8, wherein said at least one radius os no more than about 0.003 inch.

11. The cutting element of claim 8, wherein said radial width of said at least one chamfer comprises no more than about 0.003 inch.

12. The cutting element of claim 8, wherein said cutting face portion exhibits a mirror-like surface finish.

13. A drill bit for drilling subterranean formations, comprising:

a bit body;

at least one cutting element secured to said bit body, said at least one cutting element comprising:

a cutting face comprising a superabrasive mass extending in two dimensions, said cutting face including at least a portion exhibiting a surface of sufficient smoothness to substantially overcome a tendency of formation cuttings to adhere thereto; and a sharp cutting edge at an outer periphery of said cutting face portion, said cutting edge defined by at least one radius of no more than about 0.005 inch or at least one chamfer having a radial width of no more than about 0.005 inch, said cutting edge lying between said cutting face portion and a side of said superabrasive mass.

14. The drill bit of claim 13, wherein said cutting edge is worked.

15. The drill bit of claim 13, wherein said at least one radius is no more than about 0.003 inch.

16. The drill bit of claim 13, wherein said radial width of said at least one chamfer comprises no more than about 0.003 inch.

17. The drill bit of claim 13, wherein said cutting face portion exhibits a mirror-like surface finish.

18. The drill bit of claim 13, wherein an included angle between said cutting face and said side of said superabrasive mass of said at least one cutting element is no more than about 115°.

19. The drill bit of claim 13, further including at least another cutting element secured to said bit body and comprising a superabrasive cutting face exhibiting a visible chamfer at a periphery thereof.

20. The drill bit of claim 19, wherein said visible chamfer comprises no less than about a 0.007 inch radial width at said periphery of said cutting face of said at least another cutting element.

21. The drill bit of claim 13, wherein said cutting face of said at least one cutting element is oriented on said bit body at a fore-and-aft rake within a range including a positive backrake and extending to no more than about a 30° negative backrake.

22. A drill bit for drilling subterranean formations, comprising:

a bit body;

at least one cutting element secured to said bit body, said at least one cutting element comprising:

a cutting face comprising a superabrasive mass extending in two dimensions, said cutting face including at least a portion exhibiting a surface with a sufficiently low coefficient of friction to substantially overcome a tendency of formation cuttings to adhere thereto; and a sharp cutting edge at an outer periphery of said cutting face portion, said cutting edge defined by at least one radius of no more than about 0.005 inch or at least one chamfer having a radial width of no more than about 0.005 inch, said cutting edge lying between said cutting face portion and a side of said superabrasive mass.

23. The drill bit of claim 22, wherein said cutting edge is worked.

24. The drill bit of claim 22, wherein said cutting edge is defined by a radius between said cutting face and said side of no more than about 0.005 inch.

25. The drill bit of claim 22, wherein said at least one radius is no more than about 0.003 inch.

26. The drill bit of claim 22, wherein said cutting edge is defined by at least one chamfer between said cutting face and said side, wherein a radial width between a periphery of said cutting face and said side comprises no more than about 0.005 inch.

27. The drill bit of claim 22, wherein said radial width of said at least one chamfer comprises no more than about 0.003 inch.

28. The drill bit of claim 22, wherein said cutting face portion exhibits a mirror-like surface finish.

29. The drill bit of claim 22, wherein an included angle between said cutting face and said side of said at least one cutting element is no more than about 115°.

30. The drill bit of claim 22, further including at least another cutting element secured to said bit body and comprising a superabrasive cutting face exhibiting a perceptible chamfer at a periphery thereof.

31. The drill bit of claim 30, wherein said perceptible chamfer comprises no less than about a 0.007 inch radial width at said periphery of said cutting face of said at least another cutting element.

32. The drill bit of claim 22, wherein said cutting face of said at least one cutting element is oriented on said bit body at a fore-and-aft rake within a range including a positive backrake and extending to no more than about a 30° negative backrake.

33. A system for drilling a soft, plastic subterranean formation exhibiting formation cuttings instability, comprising:

a drill bit, comprising:

a bit body;

at least one cutting element secured to said bit body, said at least one cutting element comprising:

a cutting face comprising a superabrasive mass extending in two dimensions ; and a sharp cutting edge at an outer periphery of said cutting face, said cutting edge defined between said cutting face and a side of said superabrasive mass; and a drilling fluid including a constituent for rendering clays present in said subterranean formation less susceptible to agglomeration for maintaining physical integrity of cuttings cut from said subterranean formation.

34. The system of claim 33, wherein said cutting face includes at least a portion exhibiting a surface with a sufficiently low coefficient of friction to substantially overcome a tendency of formation cuttings to adhere thereto.

35. A method for drilling a soft, plastic subterranean formation, comprising:

disposing a drill bit in a well bore adjacent said formation;

rotating said drill bit and applying WOB to cause said drill bit to engage said formation;

cutting discrete, elongated cuttings of formation material with cutting elements mounted on said drill bit;

maintaining physical integrity of the cuttings while said cuttings are in proximity to said bit by introducing a clay-stabilizing additive-enhanced drilling fluid into contact therewith; and clearing said cuttings from said drill bit with said drilling fluid to a position thereabove in said well bore.

36. The method of claim 35, further including fragmenting said elongated cuttings into smaller segments prior to clearing said cuttings.

37. A drill bit for drilling subterranean formations, comprising:

a bit body;

a first plurality of superabrasive cutting elements having chamfered cutting edges and mounted to said bit body; and a second plurality of superabrasive cutting elements having sharp cutting edges and mounted to said bit body.

38. The drill bit of claim 37, wherein said cutting elements of said first and second pluralities of cutting elements are arranged at mutually redundant radial locations on said bit body.

* * * * *